US006873264B2

(12) United States Patent
Ikeda et al.

(10) Patent No.: US 6,873,264 B2
(45) Date of Patent: Mar. 29, 2005

(54) METHOD AND APPARATUS FOR DETECTING ANGULAR PHASE DIFFERENCE

(75) Inventors: Atsushi Ikeda, Hiroshima-ken (JP); Hiroshi Yamashita, Hiroshima-ken (JP); Masahiro Yamaguchi, Hiroshima-ken (JP); Junichi Ibushi, Hiroshima-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 362 days.

(21) Appl. No.: 10/019,018

(22) PCT Filed: Apr. 24, 2001

(86) PCT No.: PCT/JP01/03514

§ 371 (c)(1),
(2), (4) Date: Dec. 26, 2001

(87) PCT Pub. No.: WO01/81087

PCT Pub. Date: Nov. 1, 2001

(65) Prior Publication Data

US 2002/0158769 A1 Oct. 31, 2002

(30) Foreign Application Priority Data

Apr. 25, 2000 (JP) ..... 2000-124729

(51) Int. Cl.[7] ..... G08B 21/00

(52) U.S. Cl. ..... 340/675; 340/686.1; 340/686.3; 250/231.16; 250/231.17; 250/231.18; 341/13; 700/58; 700/59

(58) Field of Search ..... 340/686.2, 686.3, 340/675, 686.1, 679, 680; 700/56, 57, 58, 59, 61, 62; 341/13; 250/231.13, 231.14, 231.16, 231.17, 231.18, 230; 702/94, 151

(56) References Cited

U.S. PATENT DOCUMENTS

| | | | | | |
|---|---|---|---|---|---|
| 4,449,191 | A | * | 5/1984 | Mehnert | 250/231.16 |
| 5,332,895 | A | * | 7/1994 | Rieder et al. | 250/231.14 |
| 5,612,544 | A | * | 3/1997 | Busch | 250/556 |
| 5,778,791 | A | | 7/1998 | Albus et al. | |
| 5,821,531 | A | * | 10/1998 | Nomura et al. | 250/231.13 |
| 6,320,185 | B1 | * | 11/2001 | Matsuo | 250/231.13 |

FOREIGN PATENT DOCUMENTS

| | | |
|---|---|---|
| JP | 50-047090 | 4/1975 |
| JP | 60-107344 | 6/1985 |
| JP | 60-176763 | 9/1985 |
| JP | 02-261648 | 10/1990 |
| JP | 05-1418 | 1/1993 |
| JP | 5-209729 | 8/1993 |
| JP | 8-22068 | 1/1996 |
| JP | 8-498 | 3/1996 |

* cited by examiner

*Primary Examiner*—Davetta W. Goins
(74) *Attorney, Agent, or Firm*—Oblon, Spivak, McClelland, Maier & Neustadt, P.C.

(57) ABSTRACT

A rotational phase difference detecting system, a method that is capable of very accurately detecting a rotational phase difference between a plurality of rotating bodies, a machine operating-state monitoring system, and a method employing the rotational phase difference detecting system. The detecting system has a first rotating body with a first mark, a second rotating body with a second mark, a mark sensor for detecting the first mark, a first camera for imaging the second mark when the mark sensor detects the first mark, and a display section for displaying the second mark imaged by the first camera. The rotational phase difference is detected from a position of an image of the second mark displayed on the display section and is thus detected very accurately with a simple construction comprising the mark sensor, the first camera, and the display section.

26 Claims, 9 Drawing Sheets

BLOCK DIAGRAM OF A ROTATIONAL PHASE DIFFERENCE DETECTING SYSTEM OF A FIRST EMBODIMENT OF THE PRESENT INVENTION

5 : MEASURING SECTION
7 : DISPLAY SECTION
8 : REFERENCE POSITION FOR AN IMAGE PROCESSING MARK
9 : DETECTED POSITION OF AN IMAGE PROCESSING MARK
10 : IMAGE PROCESSING MARK
11, 13 : PRINTING ROLL
12 : REFERENCE MARK
15 : ROTATIONAL PHASE DIFFERENCE DETECTING SYSTEM

BLOCK DIAGRAM OF A ROTATIONAL PHASE DIFFERENCE DETECTING SYSTEM OF A FIRST EMBODIMENT OF THE PRESENT INVENTION

5 : MEASURING SECTION
7 : DISPLAY SECTION
8 : REFERENCE POSITION FOR AN IMAGE PROCESSING MARK
9 : DETECTED POSITION OF AN IMAGE PROCESSING MARK
10 : IMAGE PROCESSING MARK
11, 13 : PRINTING ROLL
12 : REFERENCE MARK
15 : ROTATIONAL PHASE DIFFERENCE DETECTING SYSTEM

FIG. 2

BLOCK DIAGRAM OF A ROTATIONAL PHASE DIFFERENCE DETECTING SYSTEM OF A SECOND EMBODIMENT OF THE PRESENT INVENTION

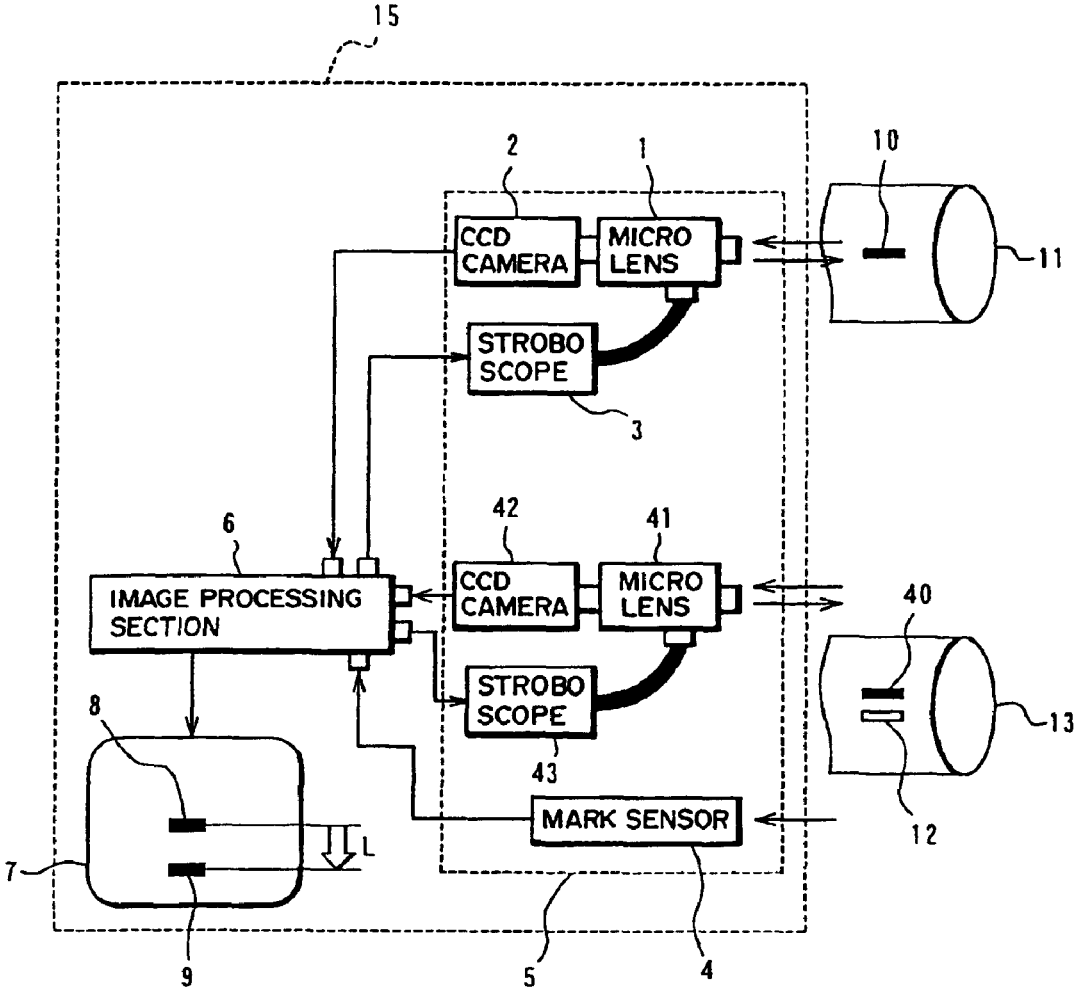

5 : MEASURING SECTION
7 : DISPLAY SECTION
8 : REFERENCE POSITION FOR AN IMAGE PROCESSING MARK
9 : DETECTED POSITION OF AN IMAGE PROCESSING MARK
10 : IMAGE PROCESSING MARK
11, 13 : PRINTING ROLL
12 : REFERENCE MARK
15 : ROTATIONAL PHASE DIFFERENCE DETECTING SYSTEM
40 : IMAGE PROCESSING MARK

CONSTRUCTION DIAGRAM OF THE MEASURING SECTION IN THE EMBODIMENT OF THE PRESENT INVENTION

1 : MICROLENS
4 : MARK SENSOR
5 : MEASURING SECTION
21 : HIGH-RIGIDITY VIBRATION-REMOVING TABLE
23 : MOUNTING ARM
24 : COUNTER WEIGHT
25 : FINE VIBRATION-REMOVING SECTION
26 : COLUMN
40 : PRINTING MACHINE
72, 82 : PLATE CYLINDER ROLL
73, 83 : PRINTING ROLL
84 : ROLL DRIVE MOTOR
85 : DRIVING GEAR

CONSTRUCTION DIAGRAM OF THE FINE-ADJUSTMENT ACTUATOR IN THE EMBODIMENT OF THE PRESENT INVENTION

1 : MICROLENS
10 : IMAGE PROCSSING MARK
11 : PRINTING ROLL
30 : FINE-ADJUSTMENT ACTUATOR
31, 32, 33 : MOTOR
37 : OPTICAL AXIS

51 : BLACK PRINTING SECTION
61 : YELLOW PRINTING SECTION
71 : RED PRINTING SECTION
81 : BLUE PRINTING SECTION
52,62,72,82 : PLATE CYLINDER ROLL
53,63,73,83 : PRINTING ROLL
64,84 : ROLL DRIVE MOTOR
65,85 : DRIVING GEAR
93 : PRINTING PAPER
95 : CAMERA

4 : MARK SENSOR
5 : MEASURING SECTION
10 : IMAGE PROCESSING MARK
11, 13 : PRINTING ROLL
12 : REFERENCE MACK

15 : ROTATIONAL PHASE DIFFERENCE DETECTING SYSTEM
16 : ROTATIONAL PHASE DIFFERENCE CALCULATING SECTION
17 : ROTATIONAL PHASE DIFFERENCE DECIDING SECTION
18 : DISPLAY SECTION
19 : ALARM DEVICE

16 : ROTATIONAL PHASE DIFFERENCE CALCULATING SECTION
18 : DISPLAY SECTION
103 : M/C OPERATION CONTROL PANEL
105 : FACTORY-SIDE SYSTEM
106 : TRANSFER MEDIUM
107 : REMOT-SIDE SYSTEM
109 : ROTATIONAL PHASE DIFFERENCE DECIDING SECTION

OUTLINE DIAGRAM OF AN OFFSET ROTARY PRINTING MACHINE

40 : PRINTING MACHINE
51 : BLACK PRINTING SECTION
52, 62, 72, 82 : PLATE CYLINDER ROLL
53, 63, 73, 83 : PRINTING ROLL
61 : YELLOW PRINTING SECTION
64, 84 : ROLL DRIVE MOTOR
65, 85 : DRIVING GEAR
71 : RED PRINTING SECTION
81 : BLUE PRINTING SECTION

EXPLANATORY DIAGRAM OF A CONVENTIONAL PHASE DIFFERENCE DETECTING METHOD

METHOD AND APPARATUS FOR DETECTING ANGULAR PHASE DIFFERENCE

TECHNICAL FIELD

The present invention relates to a method and system for detecting a rotational phase difference and a method and system for monitoring an operating state of a machine, and more particularly to a rotational phase difference detecting method and system and a machine operating-state monitoring method and system which are capable of very accurately detecting a rotational phase difference between a plurality of rotating bodies with simple construction.

BACKGROUND ART

FIG. 8 shows an outline diagram of a color offset rotary printing machine (rotary press) for performing color printing on paper, film, or the like. In the color offset rotary printing machine, blue printing, red printing, yellow printing, and black printing are performed separately by a blue printing section 81, a red printing section 71, a yellow printing section 61, and a black printing section 51, and color printing is performed while respective colors are being superposed.

That is, during the time that printing paper 93 is moving upward in the direction indicated by an arrow 94, blue printing, red printing, yellow printing, and black printing are performed sequentially by color printing rolls (blanket cylinders) 83, 73, 63, and 53.

Plate cylinder (plate cylinders) rolls 82, 72, 62, and 52 have blue, red, yellow, black printing plates on their cylindrical surfaces, respectively, and the plates are inked with blue, red, yellow, and black. While they are being rotated, the plate cylinder rolls 82, 72, 62, and 52 transfer the respective inks on the printing rolls 83, 73, 63, and 53. The blue, red, yellow, and black inks transferred on the printing rolls 83, 73, 63, and 53 are further transferred on printing paper 93, whereby color printing is performed.

In this case, a roll drive motor 64 rotates the printing roll 63 and plate cylinder roll 62 of the yellow printing section 61 and the printing roll 53 and plate cylinder roll 52 of the black printing section 51 through a driving gear 65. A roll drive motor 84 rotates the printing roll 83 and plate cylinder roll 82 of the red printing section 81 and the printing roll 73 and plate cylinder roll 72 of the red printing section 71 through a driving gear 85. Note that there are cases where each of the color printing sections is provided with a roll drive motor for independently driving the printing roll and plate cylinder roll of each color printing section.

In such a color offset rotary printing machine, high-speed and high-fine printing has been developed in recent years. However, there are cases where printing trouble called "double," or printing trouble called "out-of-register," develops. In the printing trouble called "double," inks to be transferred to the same point on the printing paper 93 are shifted from each other, and in the printing trouble called "out-of-register," color shift occurs in each color. Therefore, preventing the printing trouble has been strongly demanded.

It is conceivable that the printing trouble results from the rotational phase difference between the color printing rolls 83,73, 63, and 53 that occurs because of torsion vibration in the drive shafts, cutting and mounting errors in the driving gears 65 and 85, etc. It is therefore important to detect a rotational phase difference between the printing rolls with a high degree of accuracy and drive the printing rolls so that the rotational phase difference is eliminated.

A conventional method such as that shown in FIG. 9 has been proposed as a rotational phase difference detecting method for a printing roll system. This rotational phase difference detecting method is called a high-speed pulse clock method and utilizes the internal clock pulse of a color offset rotary printing machine, thereby detecting a rotational phase difference between printing rolls.

In FIG. 9, black-and-white patterns 90 of about 1 mm in pitch, for example, are provided on the outer peripheries of the printing rolls 73, 83. The black-and-white pattern 90 of the printing roll 73 is detected by an optical sensor 91 and the black-and-white pattern 90 of the printing roll 83 is detected by an optical sensor 92. Each of the optical sensors 91, 92 detects the black-and-white pattern 90, for example, by emitting light to the black-and-white pattern 90 and measuring the light quantity of the reflected light.

In this case, an output pulse signal A corresponding to the black-and-white pattern 90 of the printing roll 73 is obtained from the optical sensor 91, and an output pulse signal B corresponding to the black-and-white pattern 90 of the printing roll 83 is obtained from the optical sensor 92.

For example, phase differences $\Delta t1$, $\Delta t2$, and $\Delta t3$ between the output pulse signals A and B are detected by use of an internal clock pulse signal of 10 MHz. Each of the phase differences $\Delta t1$, $\Delta t2$, and $\Delta t3$ corresponds to the rotational phase difference between the printing rolls 73 and 83. Note that the accuracy of detection in this method is determined according to the pitch between the black and white sections of the pattern 90 and the frequency of the internal clock pulse signal.

Since the accuracy of detection in the rotational phase difference detecting method shown in FIG. 9 is determined by the pitch between the black and white sections of the pattern 90 and the frequency of the internal clock pulse signal, it is necessary to reduce the pitch between the black and white sections of the pattern 90 and increase the frequency of the internal clock pulse signal, in order to raise the accuracy of detection. However, if the black-and-white pattern 90 of a small pitch being rotated at high speed is detected with a high degree of accuracy, the optical sensors will need to have high resolution and the rotational phase difference detecting system will become costly.

The rotational phase difference detecting method shown in FIG. 9 also needs to calculate the rotational phase difference between the printing rolls 73 and 83 in consideration of the rotational speed of the rolls, after a phase difference between the output pulse signals A and B is detected. Because of this, a processor with high-speed performance is required for performing the calculation process at high speed and with a high degree of accuracy and makes the rotational phase difference detecting system costly.

As the rotational phase difference detecting method for a roll system, in addition to the aforementioned method, there is a method of measuring the rotational speeds of two rolls with a laser Doppler speedometer and then converting the difference between the rotational speeds to a rotational phase difference. This method, however, requires calculation of integration when converting rotational speed difference to rotational phase difference and cannot obtain accuracy necessary for practical use.

Accordingly, it is an object of the present invention to provide a rotational phase difference detecting system and a rotational phase difference detecting method which are capable of detecting a rotational phase difference between a plurality of rotating bodies with simple construction and a high degree of accuracy.

Another object of the present invention is to provide an operating-state monitoring system and an operating-state monitoring method in which there is no need for a machine operator to monitor a machine at all times, and which are capable of lessening operator's labor, by employing the rotational phase difference detecting system and method.

DISCLOSURE OF THE INVENTION

To achieve the objects of the present invention mentioned above, there is provided a rotational phase difference detecting system for detecting a rotational phase difference between a plurality of rotating bodies, comprising a first rotating body with a first mark; a second rotating body with a second mark; a mark sensor for detecting the first mark; a first camera for imaging the second mark when the mark sensor detects the first mark; and a display section for displaying the second mark imaged by the first camera; wherein a rotational phase difference between the first and second rotating bodies is detected from a position of an image of the second mark displayed on the display section.

According to the rotational phase difference detecting system of the present invention, a rotational phase difference between the first and second rotating bodies (a rotational phase difference between a plurality of rotating bodies) can be detected by a simple construction, which comprises the mark sensor for detecting the first mark (reference mark), the first camera for imaging the second mark (image processing mark), and the display section for displaying the image of the second mark. In addition, since the second mark is imaged every time the first rotating body makes one revolution, there is enough time to process an image and therefore a rotational phase difference between the first and second rotating bodies can be detected with a high degree of accuracy.

The rotational phase difference detecting system of the present invention may further comprise an actuator for driving the first camera and the optical system so that an optical axis of the optical system is approximately normal to a side surface of the second rotating body.

According to the rotational phase difference detecting system of the present invention, the second mark (image processing mark) provided on the second rotating body can be imaged in a direction approximately normal to the second rotating body. Therefore, the position of the image of the second mark on the display section can be detected with a high degree of accuracy, and a rotational phase difference between the first and second rotating bodies (a rotational phase difference between a plurality of rotating bodies) can be detected with a high degree of accuracy.

The rotational phase difference detecting system of the present invention may further comprise an arm which has the first camera and the mark sensor mounted on one end thereof and a predetermined weight mounted on the other end. In this case, the arm is mounted on a vibration removing table mounted on columns through an elastic body.

According to the rotational phase difference detecting system of the present invention, the weight of the arm is balanced by a predetermined weight and mounted on the vibration-removing table, so vibration of the first camera and the mark sensor can be extremely reduced. Therefore, the second mark (image processing mark) can be imaged with stability and a rotational phase difference between the first and second rotating bodies (a rotational phase difference between a plurality of rotating bodies) can be detected with a high degree of accuracy.

The rotational phase difference detecting system of the present invention may further comprise a second camera for imaging a third mark provided on the first rotating body when the mark sensor detects the first mark. In this case, the display section displays an image of the third mark imaged by the second camera.

According to the rotational phase difference detecting system of the present invention, the third mark (reference mark) of the first rotating body and the second mark of the second rotating body are displayed simultaneously on the display section, so a rotational phase difference between the first and second rotating bodies can be easily grasped visually.

In accordance with the present invention there is provided a first machine operating-state monitoring system comprising the aforementioned rotational phase difference detecting system. The first machine operating-state monitoring system is used for monitoring an operating state of a machine by employing the rotational phase difference detecting system.

In the first machine operating-state monitoring system of the present invention, the rotational phase difference detecting system comprises a rotational phase difference calculating section for calculating a rotational phase difference between the first and second rotating bodies, and a rotational phase difference deciding section for deciding whether or not the rotational phase difference computed by the rotational phase difference calculating section is a predetermined value or greater. Also, alarm means is provided for output an alarm in response to a signal from the rotational phase difference deciding section.

In addition, in the first machine operating-state monitoring system of the present invention, the rotational phase difference detecting system may comprise a rotational phase difference calculating section for calculating a rotational phase difference between the first and second rotating bodies, and the display section may display the calculated rotational phase difference in a time-series manner.

In accordance with the present invention, there is provided a second machine operating-state monitoring system for monitoring an operating state of a machine provided within a factory by a factory-side system and a remote-side system connected through a transfer medium, wherein the factory-side system comprises the aforementioned rotational phase difference detecting system and alarm means for outputting an alarm; the remote-side system comprises a rotational phase difference deciding section for deciding whether or not a rotational phase difference detected by the rotational phase difference detecting system is a predetermined value or greater; and when it is decided by the rotational phase difference deciding section that the rotational phase difference is the predetermined value or greater, the remote-side system transmits a signal to the factory-side system through the transfer medium, and the alarm means outputs an alarm in response to the signal.

In accordance with the present invention, there is provided a third machine operating-state monitoring system for monitoring an operating state of a machine provided within a factory by a factory-side system and a remote-side system connected through a transfer medium, wherein (1) the factory-side system comprises a first rotating body with a first mark, a second rotating body with a second mark, a mark sensor for detecting the first mark, and a first camera for imaging the second mark when the mark sensor detects the first mark; (2) the factory-side system further comprises alarm means for outputting an alarm; (3) the remote-side system comprises a rotational phase difference calculating section for calculating a rotational phase difference between the first and second rotating bodies, based on information on the second mark imaged by the first camera, and a rotational phase difference deciding section for deciding whether or not the rotational phase difference calculated by the rotational phase difference calculating section is a predetermined value or greater; and (4) when it is decided by the rotational phase difference deciding section that the rotational phase difference is the predetermined value or greater, the remote-side system transmits a signal to the factory-side system through the transfer medium, and the alarm means outputs an alarm in response to the signal.

In accordance with the present invention, there is provided a fourth machine operating-state monitoring system for monitoring an operating state of a machine provided within a factory by a factory-side system and a remote-side system connected through a transfer medium, wherein (1) the factory-side system comprises a first rotating body with a first mark, a second rotating body with a second mark, a mark sensor for detecting the first mark, and a first camera for imaging the second mark when the mark sensor detects the first mark; (2) the factory-side system further comprises a display section; (3) the remote-side system comprises a rotational phase difference calculating section for calculating a rotational phase difference between the first and second rotating bodies, based on information on the second mark imaged by the first camera; and (4) the rotational phase difference between the first and second rotating bodies, calculated by the rotational phase difference calculating section, is transmitted from the remote-side system to the factory-side system through the transfer medium and is displayed on the display section in a time-series manner.

In the aforementioned machine operating-state monitoring systems of the present invention, a print with a possibility of printing trouble is extracted by monitoring an operating state of a printing machine, and the plurality of rotating bodies are printing rolls.

In accordance with the present invention, there is provided a first machine operating-state monitoring method of monitoring an operating state of a machine by a rotational phase difference between a plurality of rotating bodies, comprising: an imaging step of imaging a second mark provided on a second rotating body by a first camera when a mark sensor detects a first mark provided on a first rotating body; and a rotational phase difference calculating step of calculating a rotational phase difference between the first and second rotating bodies, based on information on the second mark imaged by the imaging step.

The first machine operating-state monitoring method of the present invention may further comprise: a rotational phase difference deciding step of deciding whether or not the rotational phase difference calculated by the rotational phase difference calculating step is a predetermined value or greater; and an alarm output step of outputting an alarm when it is decided in the rotational phase difference deciding step that the rotational phase difference is the predetermined value or greater.

In addition, the first machine operating-state monitoring method of the present invention may further comprise a display step of displaying the rotational phase difference calculated by the rotational phase difference calculating step on a display section in a time-series manner.

In accordance with the present invention, there is provided a second machine operating-state monitoring method of monitoring an operating state of a machine provided within a factory by a factory-side system and a remote-side system connected through a transfer medium, the monitoring method comprising the steps of: detecting a rotational phase difference by the aforementioned rotational phase difference detecting system provided in the factory-side system; transmitting information on the detected rotational phase difference from the factory-side system to the remote-side system through the transfer medium; deciding whether or not the rotational phase difference is a predetermined value or greater, based on the rotational phase difference information received by a rotational phase difference deciding section provided in the remote-side system; transmitting a signal from the remote-side system to the factory-side system through the transfer medium when the phase difference deciding section decides that the rotational phase difference is the predetermined value or greater; and outputting an alarm by alarm means provided in the factory-side system when the signal is received.

In accordance with the present invention, there is provided a third machine operating-state monitoring method of monitoring an operating state of a machine provided within a factory by a factory-side system and a remote-side system connected through a transfer medium, the monitoring method comprising the steps of: imaging a second mark provided on a second rotating body by a first camera provided in the factory-side system when a mark sensor provided in the factory-side system detects a first mark provided on a first rotating body; transmitting information on the imaged second mark from the factory-side system to the remote-side system through the transfer medium; calculating a rotational phase difference between the first and second rotating bodies, based on the second-mark information received by a rotational phase difference calculating section provided in the remote-side system; deciding whether or not the calculated rotational phase difference is a predetermined value or greater, by a rotational phase difference deciding section provided in the remote-side system; transmitting a signal from the remote-side system to the factory-side system through the transfer medium when the phase difference deciding section decides that the rotational phase difference is the predetermined value or greater; and outputting an alarm by alarm means provided in the factory-side system when the signal is received.

In accordance with the present invention, there is provided a fourth machine operating-state monitoring method of monitoring an operating state of a machine provided within a factory by a factory-side system and a remote-side system connected through a transfer medium, the monitoring method comprising the steps of: imaging a second mark provided on a second rotating body by a first camera provided in the factory-side system when a mark sensor provided in the factory-side system detects a first mark provided on a first rotating body; transmitting information on the imaged second mark from the factory-side system to the remote-side system through the transfer medium; calculating a rotational phase difference between the first and second rotating bodies, based on the second-mark information received by a rotational phase difference calculating section provided in the remote-side system; transmitting information on the calculated rotational phase difference from the remote-side system to the factory-side system through the transfer medium; and displaying the transmitted information on a display section provided in the factory-side system in a time-series manner.

In the aforementioned machine operating-state monitoring methods of the present invention, a print with a possibility of printing trouble is extracted by monitoring an operating state of a printing machine, and the plurality of rotating bodies are printing rolls.

According to the machine operating-state monitoring systems and methods of the present invention, when a rotational phase difference between a plurality of rotating bodies is a predetermined value or greater, either an alarm is output from an alarm device, or the rotational phase difference is displayed on a display section in a time-series manner. Thus, the machine operator does not need to monitor a machine at all times and there is an advantage that operator's labor can be lessened.

BRIEF DESCRIPTION OF THE DRAWINGS

The present invention will be described in further detail with reference to the accompanying drawings wherein:

FIG. 2 is a block diagram of a rotational phase difference detecting system of a second embodiment of the present invention;

BEST MODE FOR CARRYING OUT THE INVENTION

Embodiments of the present invention will hereinafter be described with reference to the drawings. However, the embodiments are for the purpose of illustrating the present invention only and not for the purpose of limiting the scope of the present invention as set forth in the appended claims.

(Explanation of Method and System for Detecting Rotational Phase Difference)

Figure 1:
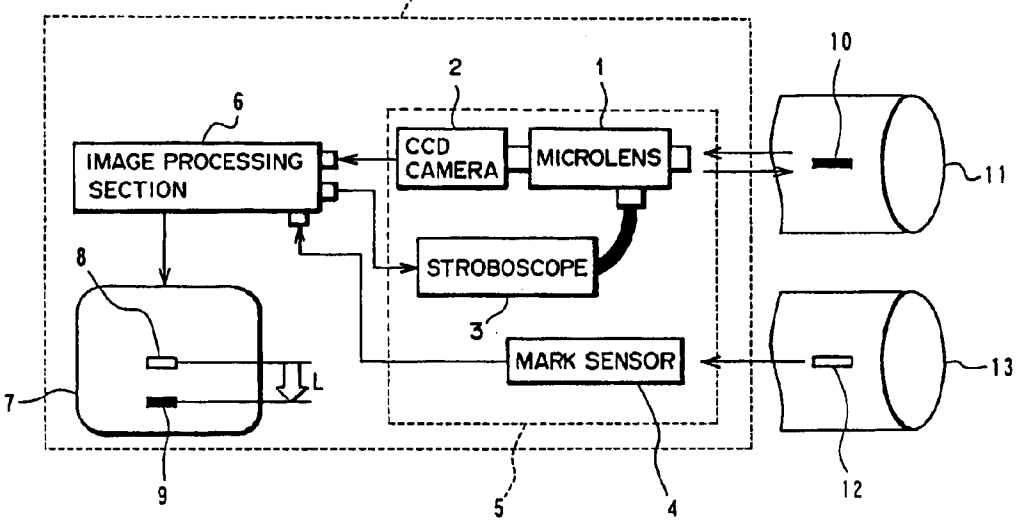
FIG. 1 is a block diagram of a rotational phase difference detecting system of a first embodiment of the present invention.

FIG. 1 shows a block diagram of a rotational phase difference detecting system of a first embodiment of the present invention. As an example, a rotational phase of a printing roll (blanket cylinder) 11 is detected with a printing roll 13 (blanket cylinder)as reference.

As shown in FIG. 1, a rotational phase difference detecting system 15 of the first embodiment has a measuring section 5, an image processing section 6 for processing an image signal output from the measuring section 5, and a display section 7 for displaying an image of an image processing mark 10. The measuring section 5 includes a microlens 1, which is an optical system, for restricting an imaging range to a predetermined range; a charge-coupled device (CCD) camera 2 for imaging an image processing mark 10 through the microlens 1; a stroboscope 3 for irradiating light to the image processing mark 10 through the microlens 1; and a mark sensor 4 for detecting a reference mark 12 provided on the printing roll 13.

In the case where a rotational phase of the printing roll 11 is detected with the printing roll 13 as reference, as described above, the reference mark 12 (first mark) is provided on the printing roll 13 and the image processing mark 10 (second mark) is provided on the printing roll 11. Note that the reference mark 12 is, for example, reflection tape for reflecting light and the image processing mark 10 is black tape.

The mark sensor 4 has a light-emitting element such as a light-emitting diode, etc., and a light-receiving element such as a photodiode, etc. The light-emitting element of the mark sensor 4 always emits a beam of light to the printing roll 13. When a rotational phase of the printing roll 13 reaches a predetermined value, the light is reflected by the reference mark 12. The reflected light is received by the light-receiving element of the mark sensor 4.

The mark sensor 4 outputs a detection signal to the image processing section 6 when the sensor 4 detects the light reflected from the reference mark 12. The image processing section 6 outputs an emission signal to the stroboscope 3 in synchronization with the detection signal from the mark sensor 4. The stroboscope 3 emits light in synchronization with the emission signal and irradiates the light to the printing roll 11 through the microlens 1.

In this case, the printing roll 11 is always imaged by the CCD camera 2 through the microlens 1. However, external light is intercepted so that it does not irradiate the imaging range of the printing roll 11. Therefore, only when light is emitted from the stroboscope 3, the image processing mark 10 can be imaged.

The image signal obtained by the CCD camera 2 is transferred to the image processing section 6, and the image is displayed on the monitor screen of the display section 7. Thus, the image processing mark 10 is imaged at a position where the mark 10 is located as the stroboscope 3 emits light. However, since the stroboscope 3 emits light each time the mark sensor 4 detects the reference mark 12, a detected position 9 of the image processing mark 10 on the monitor screen is updated each time the printing roll 13 makes one revolution.

Therefore, in the case where there is a rotational phase difference between the printing roll 11 and the printing roll 13, the detected position 9 of the image processing mark 10 on the monitor screen is displaced from reference position 8 by a value L. This value L is equivalent to the rotational phase difference between the printing roll 11 and the printing roll 13.

Note that the reference position 8 for the image processing mark 10 is, for example, a position of the image processing mark 10 at the time of the detection start of rotational phase difference, or at a predetermined reference time. The reference position 8 is set at the center of the monitor screen. Therefore, the lag or advance of the rotation of the printing roll 11 with respect to the printing roll 13 can be detected by the positional relationship between the detected position 9 of the image processing mark 10 and the reference position 8.

Thus, according to the rotational phase difference detecting system 15 of the first embodiment, a rotational phase difference between the printing rolls 11 and 13 can be detected with simple constitution. In addition, since the image processing mark 10 is imaged every time the printing roll 13 makes one revolution, there is enough time to process an image and therefore a rotational phase difference between the printing rolls 11 and 13 can be detected with a high degree of accuracy.

Note that according to the rotational phase difference detecting system 15 of the first embodiment, a rotational phase difference between two printing rolls can be detected. Therefore, for instance, in the case where a rotational phase difference between the red printing roll 73 and the blue printing roll 83 is detected with the blue printing roll 83 as reference, the reference mark 12 is provided on the blue printing roll 83 and the image processing mark 10 is provided on the red printing roll 73.

In addition, if the reference mark 12 is provided on the blue printing roll 83 and the image processing mark 10 on each of the red, yellow, and black printing rolls 73, 63, 53, a rotational phase difference between the blue printing roll 83 and each of the red, yellow, and black printing rolls 73, 63, 53 can be detected with the blue printing roll 83 as reference, by a similar method of detection.

Besides, when a rotational phase difference between printing rolls is detected by the rotational phase difference detecting system 15 of the first embodiment, high-quality color printing can be performed by feeding the rotational phase difference back to a system for driving the printing rolls and then correcting for the rotational phase difference.

FIG. 2 shows a block diagram of a rotational phase difference detecting system of a second embodiment of the present invention.

As shown in the figure, the rotational phase difference detecting system 15 of the second embodiment, as with the case of FIG. 1, detects a rotational phase of a printing roll 11 with a printing roll 13 as reference. However, a printing roll 13 is provided with an image processing mark 40 (third mark) along with a reference mark 12 (first mark).

Because of this, a measuring section 5 is provided with a microlens 1, a CCD camera 2 (first camera), and a stroboscope 3 for imaging an image processing mark 10 of the printing roll 11, and is further provided with a microlens 41, a CCD camera 42 (second camera), and a stroboscope 43 for imaging an image processing mark 40 of the printing roll 13.

In the rotational phase difference detecting system 15 of the second embodiment, the stroboscope 3 and the stroboscope 43 simultaneously emit light when a mark sensor 4 detects the reference mark 12 of the printing roll 13. Then, the image processing mark 10 of the printing roll 11 is imaged by the CCD camera 2, and the image processing mark 40 of the printing roll 13 by the CCD camera 42. The respective images are synthesized by the image processing section 6. The synthesized image is output to the monitor screen of a display section 7.

In this case, the image processing mark 40 of the printing roll 13 is imaged at the timing where the mark sensor 4 detects the reference mark 12 provided on the same printing roll 13, so an image position on the monitor screen will not move. For this reason, the image processing mark 40 of the printing roll 13 can be used as reference position 8 on the monitor screen.

Thus, according to the rotational phase difference detecting system 15 of the second embodiment, the reference position 8 (image processing mark 40) of the printing roll 13 and the detected position 9 of the image processing mark 10 of the printing roll 11 are displayed on the same monitor screen. Therefore, a rotational phase difference between the printing rolls 11 and 12 can be easily grasped visually.

Figure 3:
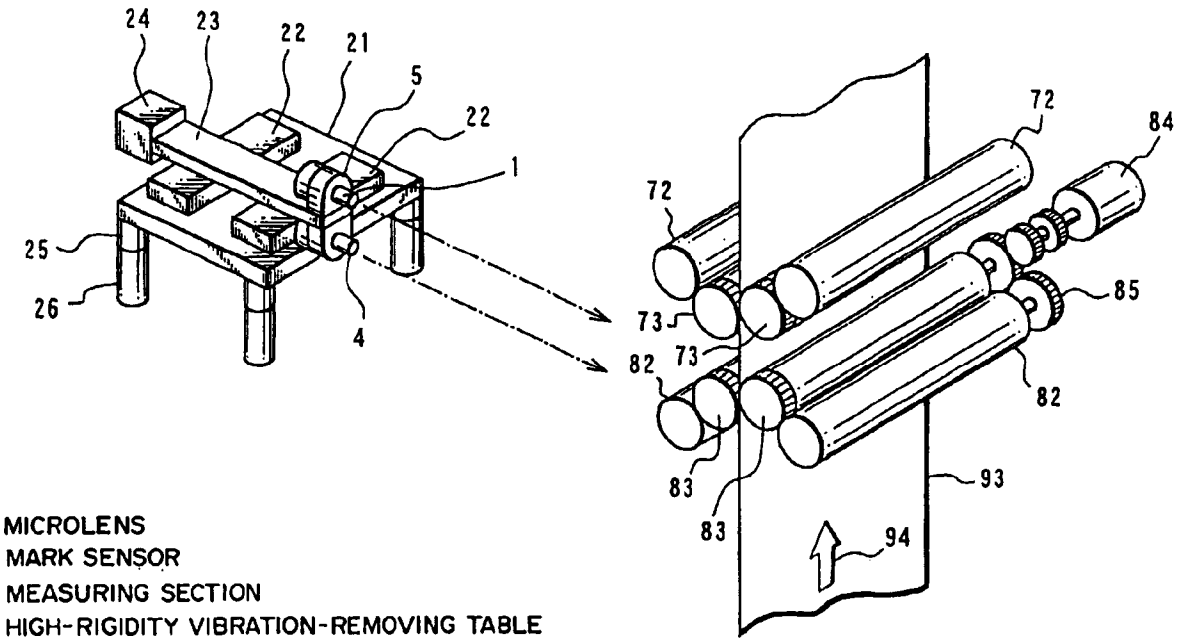
FIG. 3 is a construction diagram of a measuring section in the embodiment of the present invention.

FIG. 3 shows a construction diagram of the measuring section 5 employed in the embodiment of the present invention.

As shown in the figure, the measuring section 5 is installed on a high-rigidity vibration-removing table 21 to attenuate external vibration. The microlens 1 and mark sensor 4 of the measuring section 5 are directed so that they can detect the reference mark 12 or image processing mark 10 of the printing rolls 73, 83.

The high-rigidity vibration-removing table 21 is installed nearly horizontally through precision vibration-removing members 25 on columns 26 mounted on a floor. The vibration-removing member 25 is constructed of elastic body such as a damping coil, a spring, rubber, etc. For this reason, vibration that is transmitted from the floor to the measuring section 5 becomes extremely small, so a rotational phase difference between the printing rolls 73 and 83 can be detected with a high degree of accuracy.

The measuring section 5 is also mounted on one end of a mounting arm 23 of high rigidity. The other end of the mounting arm 23 has a counter weight 24 having nearly the same weight as the measuring section 5. The mounting arm 23 is installed on the high-rigidity vibration-removing table 21 through a height adjusting plate 22.

Thus, in the measuring section 5 of this embodiment, the weight of the mounting arm 23 is balanced by the counterweight 24 and installed on the high-rigidity vibration-removing table 21, so vibration of the measuring section 5 can be extremely reduced. Therefore, the image processing mark 10 can be imaged with stability and a rotational phase difference between the printing rolls 73 and 83 can be detected with a high degree of accuracy.

Figure 4:
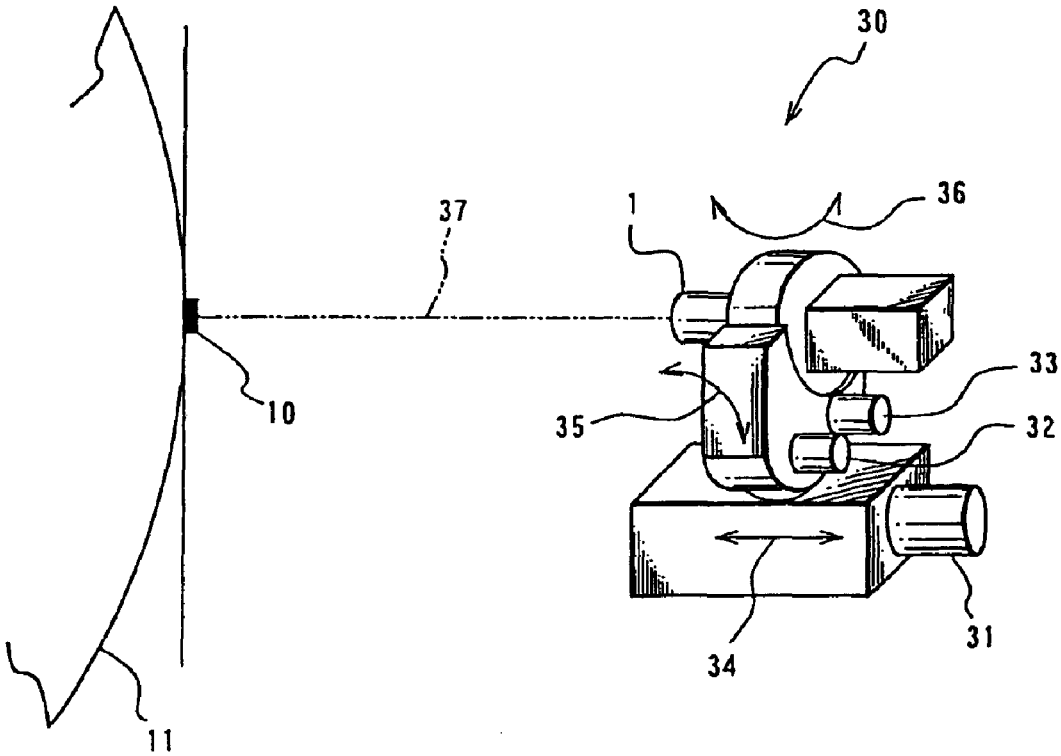
FIG. 4 is a construction diagram of a fine adjustment actuator in the embodiment of the present invention.

FIG. 4 shows a construction diagram of a fine adjustment actuator that makes fine adjustments to the direction of the optical axis of the microlens 1 of the measuring section 5.

As shown in the figure, the microlens 1 and the CCD camera 2 are driven by the fine adjustment actuator 30 so that the image processing mark 10 provided on the printing roll 11 is imaged in a direction approximately normal to the printing roll 11.

The fine adjustment actuator 30 drives the microlens 1 in a horizontal direction indicated with an arrow 34 by a motor 31 so that the microlens 1 is focused on the image processing mark 10. The fine adjustment actuator 30 also drives the microlens 1 in a direction of elevation indicated with an arrow 35 by a motor 32 and in a swivel direction indicated with an arrow 36 by a motor 33 so that the optical axis 37 of the microlens 1 is approximately normal to the printing roll 11. Note that the fine adjustment actuator 30 is capable of positioning the optical axis 37 of the microlens 1 with a right-angle accuracy of 90±0.075 degrees when the depth field of the microlens 1 is about 0.15 mm.

Thus, according to this embodiment, the image processing mark 10 provided on the printing roll 11 can be imaged in the direction approximately normal to the printing roll 11, so the position of the image processing mark 10 on the monitor screen can be detected with a high degree of accuracy. Therefore, a rotational phase difference between printing rolls can be detected with a high degree of accuracy.

(Explanation of a System and Method for Monitoring an Operating State of a Machine)

In the embodiments above mentioned, incidentally, the rotational phase difference detecting systems are capable of detecting a rotational phase difference between printing rolls with a high degree of accuracy and driving the printing rolls to eliminate the rotational phase difference, in order to prevent printing trouble, called "double," in which the same color ink is shifted and printed double, or printing trouble, called out-of-register, in which each color ink is shifted and printed. However, application of the rotational phase difference detecting system is not limited to this, but it can also be utilized in a system for monitoring an operating state of a machine.

An operating state of a machine relating to printing quality has hitherto been monitored by the following methods (1) and (2):

(1) The first method is a method in which a machine operator takes out prints discharged from a printing machine periodically during printing, or as occasion demands, and evaluates the sampled prints; and (2) The second method is a method of monitoring an operating state of a printing machine by using an amount that a motor for driving each printing roll is controlled, as an index (i.e., by using accuracy with which a motor is controlled, as an index).

In the first method, however, it is necessary to discriminate and exclude a print with printing trouble from discharged prints when printing trouble has been found, and it takes substantial labor. In addition, depending on when samples are evaluated, there is also a possibility of overlooking a print which has printing trouble. Furthermore, even in the case where there is printing trouble, it is difficult to take a quick and appropriate measure to cope with the printing trouble, because the cause of the printing trouble cannot be grasped even when a print with printing trouble is observed.

In the second method, a rotating state of a printing roll for transferring ink on paper has not been directly monitored. Because of torsion in a drive transmission shaft or backlash in gears, there is a possibility that rotational phase difference will develop between a motor and a printing roll, and there is a strong possibility that printing trouble cannot be sensed with reliability.

Figure 5:
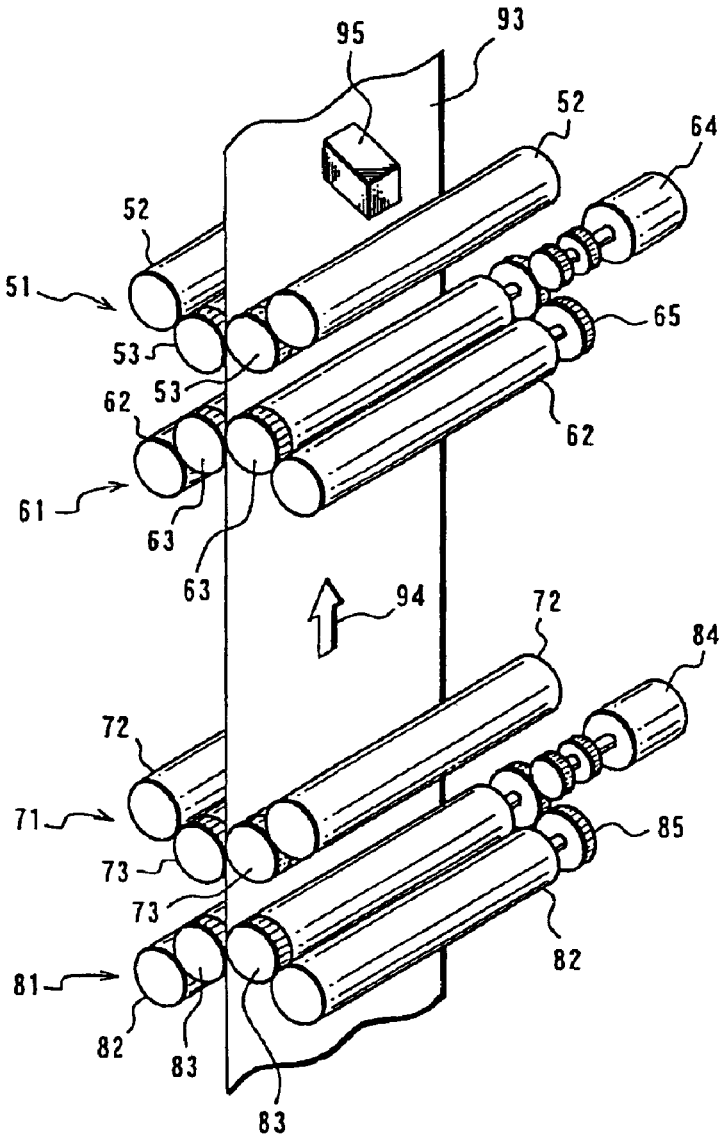
FIG. 5 is a schematic diagram for explaining a conventional method of correcting for positional shift when there is out-of-register.

When there is printing trouble called out-of-register, incidentally, corrections can be made in the following manner. Each color mark is first printed on printing paper. Then, the printed mark is imaged, for example, by a camera 95 disposed at a position such as that shown in FIG. 5. Next, based on each color mark information obtained by the camera 95, a quantity of positional shift is detected and a quantity equivalent to the positional shift quantity is corrected at the printing roll side.

However, in the case where printing trouble called out-of-register can not be eliminated by corrections made at the printing roll side, it is difficult to take a quick and appropriate measure, because the cause of the out-of-register have not been specified. That is, as the cause of the out-of-register, there are various reasons such as a rotational phase difference between printing rolls, paper expansion and construction, etc. However, since the cause cannot be specified, it is difficult to take a quick and appropriate measure in order to eliminate printing trouble called out-of-register.

In addition, in the aforementioned method it is difficult to detect printing trouble called "double," because it is hard to detect a micro-density difference between the same color inks on paper being traveled.

Hence, in a third embodiment of the present invention, in order to solve these problems, attention is directed to the fact that the cause of printing trouble, called "double" or out-of-register, is principally a rotational phase difference between printing rolls, and a machine operating-state monitoring system is constructed, utilizing the rotational phase difference detecting system of each embodiment above mentioned.

That is, the machine operating-state monitoring system is equipped with the rotational phase difference detecting system of each embodiment mentioned above. And the machine operating-state monitoring system is constructed so that it always monitors an operating state of a machine (rotating state of each printing roll) relating to printing quality by the rotational phase difference detecting system and outputs an alarm when a rotational phase difference between printing rolls reaches a predetermined value or greater. This can inform a machine operator that there is a possibility of printing trouble called double or out-of-register.

The machine operating-state monitoring system and method, utilizing the rotational phase difference detecting system, will hereinafter be described with reference to FIG. 6.

Figure 6:
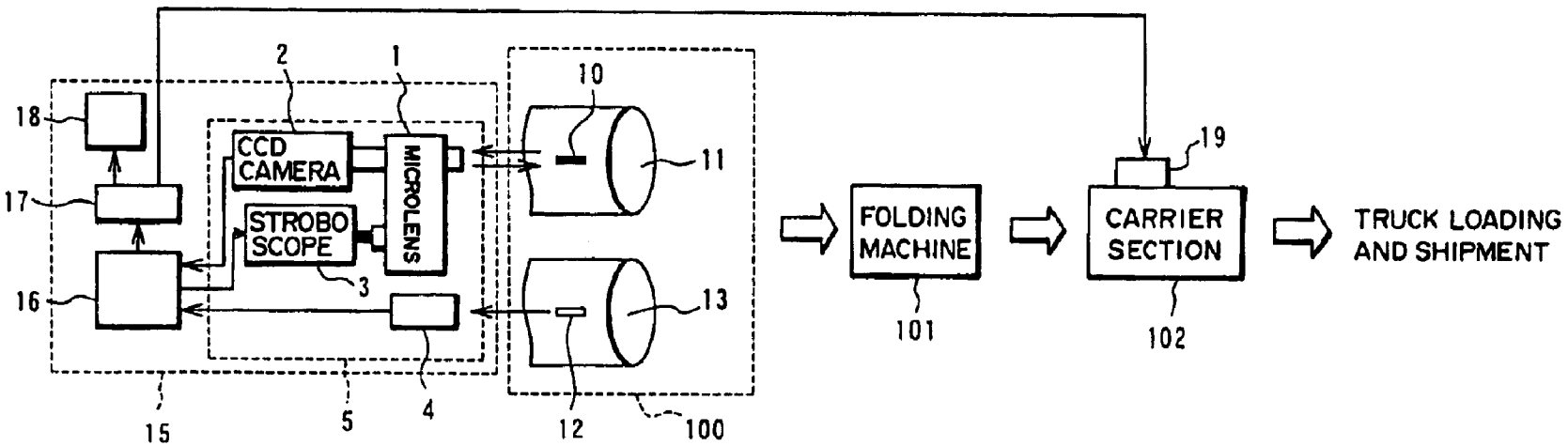
FIG. 6 is a schematic diagram showing the entire construction of a machine operating-state monitoring system according to a third embodiment of the present invention.

The machine operating-state monitoring system according to the third embodiment, as shown in FIG. 6, is equipped with a rotational phase difference detecting system 15, and an alarm (alarm means) 19 for outputting an alarm in response to a signal from the rotational phase difference detecting system 15.

The rotational phase difference detecting system 15 is equipped with a measuring section (measuring means) 5 which includes a microlens 1, a CCD camera 2, and a mark sensor 4; a rotational phase difference calculating section (rotational phase difference calculating means) 16; a rotational phase difference deciding section (rotational phase difference deciding means) 17; and a display section (display means) 18.

The measuring section 5 is constructed the same as that of the first embodiment. Therefore, when a reference mark (first mark) provided on a first printing roll (first rotating body) 13 is detected by the mark sensor 4, an image processing mark (second mark) 10 provided on a second printing roll (second rotating body) 11 is imaged by the CCD camera (first camera) 2.

Note that the measuring section 5 may be constructed like that of the second embodiment (see FIG. 2). That is, an image processing mark (third mark) 40, along with a reference mark 12, is provided on a printing roll 13. And a microlens 41, a CCD camera (second camera) 42, and a stroboscope 43 are provided for imaging the image processing mark 40. The stroboscope 3 and the stroboscope 43 simultaneously emit light when the mark sensor 4 detects the reference mark 12 provided on the printing roll 13. With this arrangement, the image processing mark 10 provided on the printing roll 11 is imaged by the CCD camera 2, and the image processing mark 40 provided on the printing roll 13 is imaged by the CCD camera 42.

The rotational phase difference calculating section 16 calculates a rotational phase difference between the printing rolls 11 and 13, based on information on the image processing mark 10 imaged by the measuring section 5 (positional information in the case where an image signal is developed on memory: based on this positional information, an image is displayed on the monitor screen of the display section). That is, the rotational phase difference calculating section 16 is constructed so that it calculates a rotational phase difference between the printing rolls 11 and 13, based on the positional information of the image processing mark 10 imaged with the measuring section 5.

More specifically, the rotational phase difference calculating section 16 calculates a rotational phase difference between the printing rolls 11 and 13, based on the positional information (detected-position information) of the detected position 9 of the image processing mark 10 imaged by the measuring section 5, and the positional information (reference-position information) of the reference position 8 of the image processing mark 10 being previously set.

In the case where the measuring section 5 is constructed like the second embodiment (see FIG. 2), the rotational phase difference calculating section 16 calculates a rotational phase difference between the printing rolls 11 and 13, based on the positional information (detected-position information) of the detected position 9 of the image processing mark 10 imaged by the measuring section 5, and the positional information (reference-position information) of the detected position (reference position 8) of the image processing mark 40 imaged by the measuring section 5.

In this embodiment, the microlens 1 and the CCD camera 2 detect the image processing mark 10 when the mark sensor 4 detects the reference mark 12. Therefore, each time the mark sensor 4 detects the reference mark 12 (i.e., each time the mark sensor 4 detects both the reference mark 12 and the image processing mark 10), a rotational phase difference between the printing rolls 11 and 13 is calculated.

In this embodiment, the first printing roll (first rotating body) 13 is used as a reference roll, and how much rotational phase difference the second printing roll (second rotating body) 11 (there are actually a plurality of rotating bodies, although not shown) has with respect to the rotational phase of the first printing roll 11 is calculated as a rotational phase difference between the two printing rolls 11 and 13. Among the printing rolls of the black printing section 51, yellow printing section 61, red printing section 71, and blue printing section 81, any printing roll can be used as a reference roll.

The rotational phase difference deciding section 17 decides whether or not the rotational phase d difference between the printing rolls 11 and 13, calculated by the rotational phase difference calculating section 16, has reached a predetermined value (threshold value) or greater. When, as a result of this decision, it is decided that the rotational phase difference has reached a predetermined value (threshold value) or greater, it is decided that there is a possibility of printing trouble such as double, out-of-register, etc. Therefore, the rotational phase difference deciding section 17 outputs a signal (which represents abnormality) to a display section 18, or the alarm device 19 of a carrier section 102.

In this embodiment, the rotational phase difference deciding section 17 outputs a signal when the difference between the rotational phase of the printing roll (reference roll) 13 and the rotational phase of any one of a plurality of printing rolls 11 has reached a predetermined value or greater.

Note that the present invention is not to be limited to the rotational phase difference deciding section 17 mentioned above. For instance, the rotational phase difference deciding section 17 may output a signal when the rotational phase difference between the printing roll (reference roll) 13 and two printing rolls of the printing rolls 11 has reached a predetermined value or greater, or when the rotational phase difference between the printing roll (reference roll) 13 and all the printing rolls 11 has reached a predetermined value or greater.

Particularly, when it decides that the rotational phase difference has reached a predetermined value or greater, the rotational phase difference deciding section 17 outputs a signal to the alarm device 19 of the carrier section 102 so that an alarm is output from the alarm device 19 when a print, formed from folded printing paper having a possibility of printing trouble, reaches the carrier section 102.

When the rotational phase difference deciding section 17 decides that a rotational phase difference between the printing rolls 11 and 13 has reached a predetermined value (threshold value) or greater and therefore decides that there is a possibility of printing trouble, the display section 18 displays that effect.

In this embodiment, that effect is displayed by the display section 18. However, in addition to this, the rotational phase difference detecting system 15 may have an alarm device to output an alarm. As the alarm, a light may be turned on, or on and off, or an alarm may be sounded.

On the other hand, the alarm device 19 is provided in the carrier section 102 of a printing machine. That is, generally, in a printing machine, printing paper 93 printed at a printing section 100 is sent to a folding machine 101, in which it is folded and produced as a print. The print is serially sent from the folding machine 101 to the carrier section 102 and is stacked. And it is shipped by a truck. The alarm device 19 is provided in the carrier section 102 of such a printing machine.

This alarm device 19 is used for outputting an alarm in response to a signal from the rotational phase difference detecting system 15. That is, the alarm device 19 receives a signal from the rotational phase difference detecting system 15, when the rotational phase difference deciding section 17 decides that a rotational phase difference between the printing rolls 11 and 13 has reached a predetermined value (threshold value) or greater and therefore decides that there is a possibility of printing trouble. If it receives a signal from the rotational phase difference detecting system 15, the alarm device 19 outputs an alarm. As the alarm, a light can be turned on, or on and off, or an alarm can be sounded, or an alarm can be displayed.

The machine operating-state monitoring system of this embodiment is constructed as described above, so a machine operating-state monitoring method is carried out by the monitoring system as follows:

In the measuring section 5 of the rotational phase difference detecting system 15, the reference mark (first mark) 12 provided on the first printing roll (first rotating body) 13 is detected by the mark sensor 4, and at the same time, the image processing mark (second mark) 10 provided on the second printing roll (second rotating body) 11 is imaged by the CCD camera (first camera) 2 (imaging step).

In the case where the measuring section 5 is constructed like the second embodiment (see FIG. 2), the reference mark (first mark) 12 provided on the first printing roll (first rotating body) 13 is detected by the mark sensor 4, and at the same time, the image processing mark (second mark) 10 provided on the second printing roll (second rotating body) 11 is imaged by the CCD camera (first camera) 2, and furthermore, the image processing mark (third mark) 40 provided on the printing roll 13 is imaged by the CCD camera (second camera) 42 (imaging step).

Next, the rotational phase difference calculating section 16 of the rotational phase difference detecting system 15 calculates a rotational phase difference between the printing rolls 11 and 13, based on information on the image processing mark 10 imaged by the measuring section 5 (positional information in the case where an image signal is developed on memory: based on this positional information, an image is displayed on the monitor screen of the display section 18). This step is referred to as a rotational phase difference calculating step. That is, the rotational phase difference calculating section 16 calculates a rotational phase difference between the printing rolls 11 and 13, based on the positional information of the image processing mark 10 imaged with the measuring section 5.

More specifically, the rotational phase difference calculating section 16 calculates a rotational phase difference between the printing rolls 11 and 13, based on the positional information (detected-position information) of the detected position 9 of the image processing mark 10 imaged by the measuring section 5, and the positional information (reference-position information) of the reference position 8 of the image processing mark 10 being previously set.

In the case where the measuring section 5 is constructed like the second embodiment (see FIG. 2), the rotational phase difference calculating section 16 calculates a rotational phase difference between the printing rolls 11 and 13, based on the positional information (detected-position information) of the detected position 9 of the image processing mark 10 imaged by the measuring section 5, and the positional information (reference-position information) of the detected position (reference position 8) of the image processing mark 40 imaged by the measuring section 5.

In this embodiment, the rotational phase difference calculating section 16 calculates a rotational phase difference between the printing rolls 11 and 13, each time the mark sensor 4 detects the reference mark 12 (i.e., each time the mark sensor 4 detects both the image processing mark 10 and the reference mark 12).

Next, the rotational phase difference deciding section 17 of the rotational phase difference detecting system 15 decides whether or not the rotational phase difference between the printing rolls 11 and 13, calculated in the rotational phase difference calculating step, is a predetermined value or greater (rotational phase difference deciding step).

Next, the rotational phase difference deciding section 17 outputs a signal to the display section 18 or the alarm device 19 of the carrier section 102 when it decides that a rotational phase difference between the printing rolls 11 and 13 is a predetermined value or greater (signal output step).

In response to the signal from the rotational phase difference deciding section 17, the alarm device 19 of the carrier section 102 outputs an alarm (alarm output step).

Therefore, according to the machine operating-state monitoring system and method of this embodiment, an alarm is output from the alarm device 19 of the carrier section 102 when a rotational phase difference between the printing rolls 11 and 13 is a predetermined value or greater. Thus, the machine operator does not need to always monitor whether or not printing trouble has developed. When an alarm is output, in the carrier section 102 printing paper (print) having a possibility of printing trouble such as double, out-of-register, etc., is picked up and it is decided whether or not it can be shipped. In the case where a print has such printing trouble as cannot be shipped, the print can be discriminated and excluded. Thus, there is an advantage that operator's labor can be lessened.

In addition, since the alarm device 19 of the carrier section 102 outputs an alarm when a rotational phase difference between the printing rolls 11 and 13 reaches a predetermined value or greater, there is no possibility that a print with printing trouble will be overlooked. Thus, there is also an advantage that a print with printing trouble can be discriminated and excluded with reliability.

Furthermore, because the alarm device 19 of the carrier section 102 outputs an alarm when a rotational phase difference between the printing rolls 11 and 13 reaches a predetermined value or greater, the machine operator can recognize that the rotational phase difference between the printing rolls 11 and 13 has reached a predetermined value or greater. Thus, as it is found that the cause of the printing trouble is a rotational phase difference developing between the printing rolls 11 and 13, it becomes possible to take a quick and appropriate measure.

(Explanation of a Modification of the Machine Operating-State Monitoring System and Method)

A machine operating-state monitoring system and method according to a modification of the aforementioned embodiment will be described with reference to FIG. 7.

While the machine operating-state monitoring system of the aforementioned embodiment is constructed so that it monitors an operating state of a machine at a factory side, the machine operating-state monitoring system of the modified embodiment is constructed so that it can monitor an operating state of a machine at a remote place.

Figure 7:
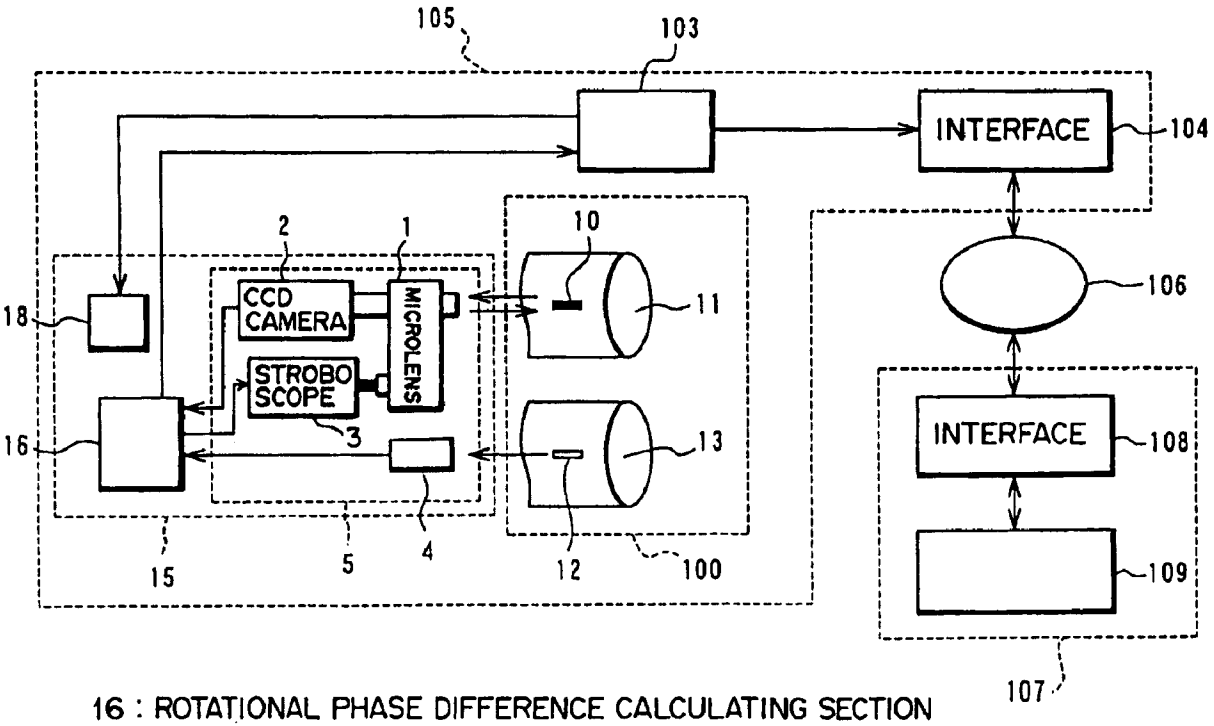
FIG. 7 is a schematic diagram showing the entire construction of a machine operating-state monitoring system according to a modification of the third embodiment.
Figure 8:
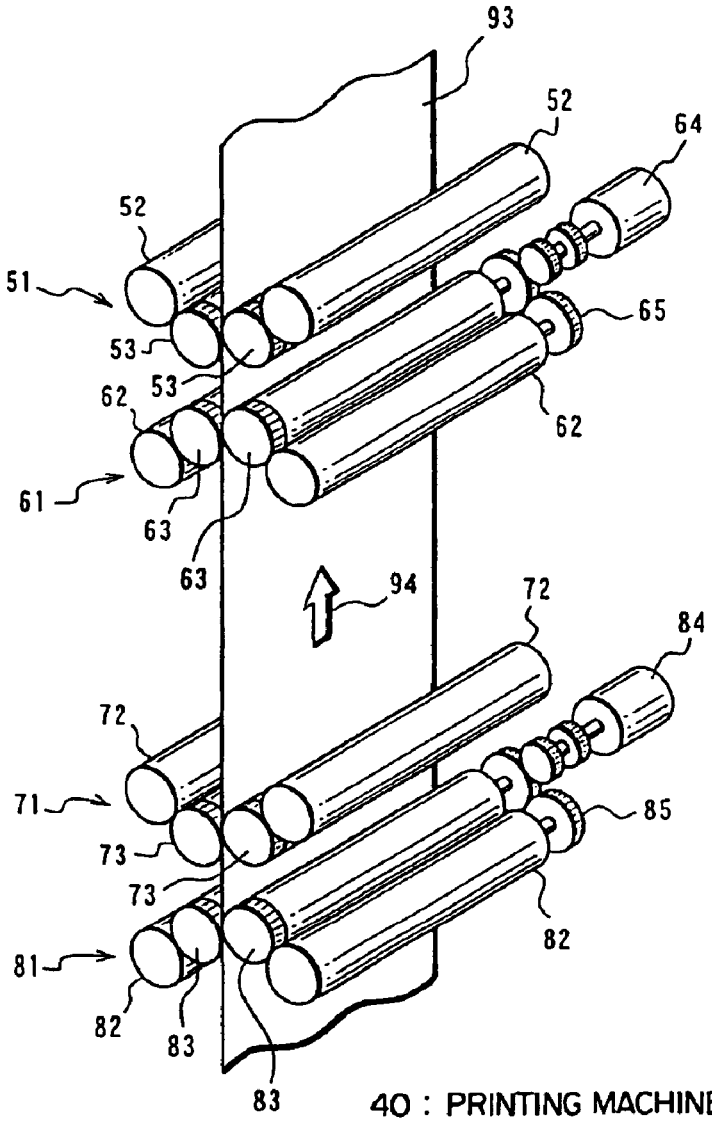
FIG. 8 is a diagrammatic diagram of an offset rotary printing machine.
Figure 9:
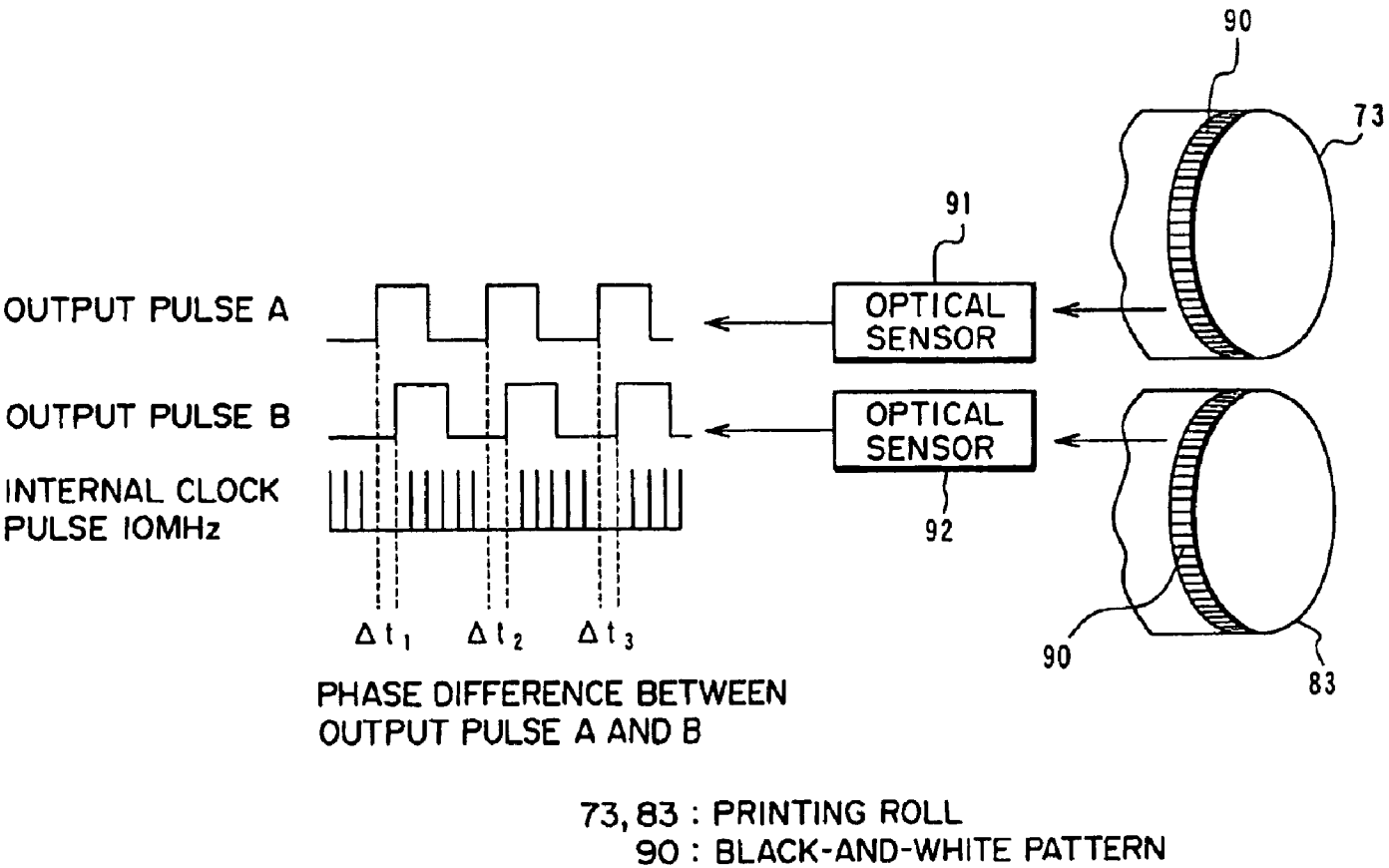
FIG. 9 is an explanatory diagram of a conventional phase difference detecting method.

For this reason, the machine operating-state monitoring system is equipped with a factory-side system 105 and a remote-side system 107, as shown in FIG. 7. The factor-side system 105 has a rotational phase difference detecting system 15, an M/C operation control panel 103, and an interface (transmission-reception means) 104, while the remote-side system 107 has an interface (transmission-reception means) 108 and a rotational phase difference deciding section (rotational phase difference deciding means) 109. The factory-side system 105 and the remote-side system 107 are connected through a transfer medium 106 so that they can communicate with each other.

The rotational phase difference detecting system 15 in the factory-side system 105 is equipped with a measuring section (measuring means) 5 including a microlens 1, a CCD camera 2, and a mark sensor 4; a rotational phase difference calculating section (rotational phase difference calculating means) 16; and a display section (display means) 18. Note that the measuring section 5, the rotational phase difference calculating section 16, and the display section 18 are also constructed the same as those of the aforementioned embodiments.

The transfer medium 106 refers to a communication line, such as a telephone line, an Internet line, etc., for example, in the case of wire communication and also refers to a carrier wave, such as an electromagnetic wave, etc., in the case of wireless communication (Including Wireless Communication that Utilizes Artificial Satellites).

Note that the transfer medium 106 is not limited particularly to the aforementioned media, because it will be satisfied if it can be employed as communication means between the factory-side system 105 and the remote-side system 107. It may be any medium, as long as it sends a signal between the factory-side system 105 and the remote-side system 107.

The rotational phase difference deciding section 109 of the remote-side system 107 is constructed the same as the rotational phase difference deciding section 17 of the rotational phase difference detecting system 15 of the above-mentioned embodiment.

The machine operating-state monitoring system according to the modified embodiment is constructed as described above, so an operating-state of a machine can be monitored by the following method.

In the measuring section 5 of the rotational phase difference detecting system 15, as with the above-mentioned embodiment, the reference mark (first mark) 12 provided on the first printing roll (first rotating body) 13 is detected by the mark sensor 4, and at the same time, the image processing mark (second mark) 10 provided on the second printing roll (second rotating body) 11 is imaged by the CCD camera (first camera) 2 (imaging step).

In the case where the measuring section 5 is constructed like the second embodiment (see FIG. 2), the reference mark (first mark) 12 provided on the first printing roll (first rotating body) 13 is detected by the mark sensor 4, and at the same time, the image processing mark (second mark) 10 provided on the second printing roll (second rotating body) 11 is imaged by the CCD camera (first camera) 2, and furthermore, the image processing mark (third mark) 40 provided on the printing roll 13 is imaged by the CCD camera (second camera) 42 (imaging step).

Next, the rotational phase difference calculating section 16 of the rotational phase difference detecting system 15 calculates a rotational phase difference between the printing rolls 11 and 13, based on information on the image processing mark 10 imaged by the measuring section 5 (positional information in the case where an image signal is developed on memory: based on this positional information, an image is displayed on the monitor screen of the display section 18). This step is referred to as a rotational phase difference calculating step. That is, the rotational phase difference calculating section 16 calculates a rotational phase difference between the printing rolls 11 and 13, based on the positional information of the image processing mark 10 imaged with the measuring section 5.

More specifically, the rotational phase difference calculating section 16 calculates a rotational phase difference between the printing rolls 11 and 13, based on the positional information (detected-position information) of the detected position 9 of the image processing mark 10 imaged by the measuring section 5, and the positional information (reference-position information) of the reference position 8 of the image processing mark 10 being previously set.

In the case where the measuring section 5 is constructed like the second embodiment (see FIG. 2), the rotational phase difference calculating section 16 calculates a rotational phase difference between the printing rolls 11 and 13, based on the positional information (detected-position information) of the detected position 9 of the image processing mark 10 imaged by the measuring section 5, and the positional information (reference-position information) of the detected position (reference position 8) of the image processing mark 40 imaged by the measuring section 5.

In the modified embodiment, the rotational phase difference calculating section 16 calculates a rotational phase difference between the printing rolls 11 and 13, each time the mark sensor 4 detects the reference mark 12 (i.e., each time the mark sensor 4 detects both the image processing mark 10 and the reference mark 12).

Next, information on the rotational phase difference (rotational phase difference information) detected by the rotational phase difference detecting system 15 of the factory-side system 105 is input to the M/C operation control panel 103. The rotational phase difference information is transmitted to the rotational phase difference deciding section 109 of the remote-side system 107 through the interface 104 of the factory-side system 105, the transfer medium 106, and the interface 108 of the remote-side system 107 (rotational phase difference transmitting step).

Based on the rotational phase difference information between the printing rolls 11 and 13, the rotational phase difference deciding section 109 of the remote-side system 107 decides whether or not the rotational phase difference between the printing rolls 11 and 13 is a predetermined value or greater (rotational phase difference deciding step).

When, as a result of this decision, it is decided that the rotational phase difference between the printing rolls 11 and 13 has reached a predetermined value or greater, it is decided that there is a possibility of printing trouble such as double, out-of-register, etc. Therefore, the rotational phase difference deciding section 109 of the remote-side system 107 transmits a signal (which represents abnormality) to the factory-side system 105 through the interface 108 of the remote-side system 107, the transfer medium 106, and the interface 104 of the factory-side system 105 (signal transmission step).

The signal from the rotational phase difference deciding section 109 of the remote-side system 107 is input to the M/C operation control panel 103 of the factory-side system 105 and is sent from the M/C operation control panel 103 to the display section 18. As a result, it is displayed on the display screen of the display section 18 that there is a possibility of printing trouble (display step).

When such display is performed, in the carrier section 102 of the printing machine the machine operator picks up printing paper (print) having a possibility of printing trouble such as double, out-of-register, etc., and then decides whether or not it can be shipped. In the case where the print has such printing trouble as cannot be shipped, the print is excluded.

In the modified embodiment, the signal from the rotational phase difference deciding section 109 of the remote-side system 107 is sent to the display section 18 of the rotational phase difference detecting system 15, and it is displayed on the display section 18 that there is a possibility of printing trouble. However, the present invention is not limited to this arrangement. As in the aforementioned embodiments, the carrier section 102 may be provided with an alarm device (alarm means) so that the signal from the rotational phase difference deciding section 109 of the remote-side system 107 is also sent to the alarm device. The alarm device in the carrier section 102 may output an alarm.

In this case, an alarm is output from the alarm device provided in the carrier section 102. Therefore, the machine operator is able to pick up printing paper (print) having a possibility of printing trouble such as double, out-of-register, etc., decide whether or not the print can be shipped, and, when it is decided that it has such printing trouble as cannot be shipped, exclude the print.

Therefore, the machine operating-state monitoring system and method according to the modified embodiment have the same advantages as the aforementioned embodiments and, even in the case where it is difficult to monitor an operating state of a machine at a factory side, also has the advantage that it can monitor an operating state of a machine.

In the modified embodiment, the monitoring system is provided with the rotational phase difference detecting system 15 of the factory-side system 105; the rotational phase difference calculating section 16 of the rotational phase difference detecting system 15 calculates a rotational phase difference between the printing rolls 11 and 13; and the calculated rotational phase difference is transmitted to the remote-side system 107. However, information on the image processing mark 10, detected by the microlens 1 and CCD camera 2 of the rotational phase difference detecting system 15, may be transmitted to the remote-side system 107 so that a rotational phase difference between printing rolls can be calculated at the side of the remote-side system 107. In this case, the remote-side system 107 needs to have the rotational phase difference calculating section 16.

In addition, in the aforementioned embodiments and modified embodiment, a rotational phase difference between printing rolls is first calculated; then it is decided whether or not the calculated rotational phase difference is a predetermined value or greater; and when, as a result of this decision, the rotational phase difference is a predetermined value or greater, it is displayed on the display section 18 of the rotational phase difference detecting system 15 that there is a possibility of printing trouble. However, the present invention is not to be limited to these embodiments. For instance, a rotational phase difference between printing rolls may be calculated by the rotational phase difference calculating section, and the calculated rotational phase difference may be displayed on the display section 18 in a time-series manner.

If the rotational phase difference is displayed on the display section 18 in the aforementioned manner, the machine operator can obtain information on the rotational phase difference beforehand by viewing a value of the rotational phase difference, or a change in the rotational phase difference, displayed on the display section 18. Based on the information, in the carrier section 102 the machine operator is able to pick up printing paper (print) having a possibility of printing trouble such as double, out-of-register, etc., decide whether or not the print can be shipped, and, when it is decided that it has such printing trouble as cannot be shipped, discriminate and exclude the print. Therefore, operator's labor can be reduced compared with the conventional method in which the machine operator always monitors whether or not printing trouble has developed and arbitrary extracts samples to decide whether or not printing trouble has developed.

The machine operator is also able to reliably discriminate and exclude a print having printing trouble without overlooking the print, because he or she is able to obtain information on the rotational phase difference beforehand.

The machine operator is further able to take a quick and appropriate measure, because he or she is able to obtain information on the rotational phase difference beforehand and find that the cause of printing trouble is the rotational phase difference between the printing rolls 11 and 13.

While the present invention has been described with reference to the case where a rotational phase difference between a plurality of printing rolls is detected, the invention is not to be limited to the detection of a rotational phase difference between printing rolls, but is also applicable to the case where a rotational phase difference between rotating bodies, such as rotary disks, rotating drums, etc., is detected.

Although the present invention has been described with a certain degree of particularity, it is understood that the present disclosure has been made only by way of example and that numerous changes in the details of the construction and the combination and arrangement of the parts may be made without departing from the scope of the invention hereinafter claimed.

INDUSTRIAL APPLICABILITY

The rotational phase difference detecting system and method and the rotational phase difference monitoring system and method of the present invention are useful to detect a rotational phase difference between rotating bodies such as printing rolls, rotary disks, rotating drums, etc., and are particularly suitable to be employed in offset rotary printing machines where color printing is performed by transferring color inks with color printing rolls and superposing respective colors.

What is claimed is:

1. A rotational phase difference detecting system for detecting a rotational phase difference between a plurality of rotating bodies, comprising:

a first rotating body with a first mark;

a second rotating body with a second mark;

a mark sensor configured to detect said first mark; and a first camera configured to image said second mark when said mark sensor detects said first mark, a display section configured to display said second mark imaged by said first camera, wherein a rotational phase difference between said first and second rotating bodies is detected from a position of an image of said second mark displayed on said display section.

2. The rotational phase difference detecting system as set forth in claim 1, further comprising:

an optical system configured to restrict an imaging range of said first camera, wherein said first camera images said second mark through said optical system.

3. The rotational phase difference detecting system as set forth in claim 2, further comprising:

a light-emitting device configured to emit light to said second rotating body through said optical system, wherein light from said light-emitting device is irradiated to said second rotating body when said mark sensor detects said first mark.

4. The rotational phase difference detecting system as set forth in claim 2, further comprising:

an actuator configured to drive said first camera and said optical system, such that an optical axis of said optical system is approximately normal to a side surface of said second rotating body.

5. The rotational phase difference detecting system as set forth in claim 1, further comprising:

an arm which has said first camera and said mark sensor mounted on one end thereof and a predetermined weight mounted on the other end, wherein said arm is mounted on a vibration removing table mounted on columns through an elastic body.

6. A rotational phase difference detecting system for detecting a rotational phase difference between a plurality of rotating bodies, comprising:

a first rotating body with a first mark;

a second rotating body with a second mark;

a mark sensor configured to detect said first mark;

a first camera configured to image said second mark when said mark sensor detects said first mark;

a second camera configured to image a third mark provided on said first rotating body when said mark sensor detects said first mark;

a display section configured to display said second mark imaged by said first camera and said third mark imaged by said second camera, wherein a rotational phase difference between said first, second, and third rotating bodies is detected from a position of an image of said second and third marks displayed on said display section.

7. A rotational phase difference detecting method of detecting a rotational phase difference between a plurality of rotating bodies, comprising:

detecting a first mark provided on a first rotating body;

imaging and displaying a second mark provided on a second rotating body, when said first mark is detected; and detecting a rotational phase difference between said first and second rotating bodies from a position of an image of said second mark.

8. A rotational phase difference detecting method of detecting a rotational phase difference between a plurality of rotating bodies, comprising:

detecting a first mark provided on a first rotating body;

imaging and displaying a second mark provided on a second rotating body and a third mark provided on said first rotating body, when said first mark is detected;

detecting a position of an image of said second mark with an image of said third mark as reference; and detecting a rotational phase difference between said first and second rotating bodies from a position of an image of said second mark.

9. A machine operating-state monitoring system, comprising the rotational phase difference detecting system as set forth in claim 1, the machine operating-state monitoring system configured to monitor an operating state of a machine by employing said rotational phase difference detecting system.

10. The machine operating-state monitoring system as set forth in claim 9, wherein said rotational phase difference detecting system further comprises:

a rotational phase difference calculating section configured to calculate the rotational phase difference between the first and second rotating bodies, and a rotational phase difference deciding section configured to decide whether or not the rotational phase difference computed by said rotational phase difference calculating section is a predetermined value or greater; and an alarm that outputs an alarm in response to a signal from said rotational phase difference deciding section.

11. The machine operating-state monitoring system as set forth in claim 9, wherein said rotational phase difference detecting system further comprises a rotational phase difference calculating section configured to calculate the rotational phase difference between the first and second rotating bodies; and said display section displays the calculated rotational phase difference in a time-series manner.

12. A machine operating-state monitoring system for monitoring an operating state of a machine provided within a factory, by a factory-side system and a remote-side system connected through a transfer medium, wherein:

said factory-side system comprises an alarm and a rotational phase difference detecting system for detecting a rotational phase difference between a plurality of rotating bodies, the rotational phase difference detecting system including a first rotating body with a first mark, a second rotating body with a second mark, a mark sensor configured to detect said first mark, a first camera configured to image said second mark when said mark sensor detects said first mark, and a display section configured to display said second mark imaged by said first camera, the rotational phase difference between said first and second rotating bodies being detected from a position of an image of said second mark displayed on said display section;

said remote-side system comprises a rotational phase difference deciding section configured to decide whether or not the rotational phase difference detected by the rotational phase difference detecting system is a predetermined value or greater; and when said rotational phase difference deciding section decides that said rotational phase difference is said predetermined value or greater, said remote-side system transmits a signal to said factory-side system through said transfer medium, and said alarm outputs an alarm in response to said signal.

13. A machine operating-state monitoring system for monitoring an operating state of a machine provided within a factory, by a factory-side system and a remote-side system connected through a transfer medium, wherein:

said factory-side system comprises, a first rotating body with a first mark, a second rotating body with a second mark, a mark sensor configured to detect said first mark, a first camera configured to image said second mark when said mark sensor detects said first mark, and an alarm;

said remote-side system comprises, a rotational phase difference calculating section configured to calculate a rotational phase difference between the first and second rotating bodies, based on information on said second mark imaged by said first camera, and a rotational phase difference deciding section configured to decide whether or not the rotational phase difference calculated by said rotational phase difference calculating section is a predetermined value or greater; and when said rotational phase difference deciding section decides that said rotational phase difference is said predetermined value or greater, said remote-side system transmits a signal to said factory-side system through said transfer medium, and in response to said signal, said alarm outputs an alarm.

14. A machine operating-state monitoring system for monitoring an operating state of a machine provided within a factory, by a factory-side system and a remote-side system connected through a transfer medium, wherein:

said factory-side system comprises, a first rotating body with a first mark, a second rotating body with a second mark, a mark sensor configured to detect said first mark, and a first camera configured to image said second mark when said mark sensor detects said first mark, and a display section;

said remote-side system comprises, a rotational phase difference calculating section configured to calculate a rotational phase difference between the first and second rotating bodies, based on information on said second mark imaged by said first camera; and the rotational phase difference between the first and second rotating bodies, calculated by said rotational phase difference calculating section, is transmitted from said remote-side system to said factory-side system through said transfer medium and is displayed on said display section in a time-series manner.

15. The machine operating-state monitoring system as set forth in any one of claims 9 through 14, wherein:

a print with a possibility of printing trouble is extracted by monitoring an operating state of a printing machine; and said plurality of rotating bodies are printing rolls.

16. A machine operating-state monitoring method of monitoring an operating state of a machine by a rotational phase difference between a plurality of rotating bodies, comprising:

imaging a second mark provided on a second rotating body by a first camera when a mark sensor detects a first mark provided on a first rotating body; and calculating the rotational phase difference between said first and second rotating bodies, based on information on said second mark imaged by said imaging step.

17. The machine operating-state monitoring method as set forth in claim 16, further comprising:

deciding whether or not said rotational phase difference calculated by said rotational phase difference calculating step is a predetermined value or greater; and outputting an alarm when said rotational phase difference deciding step decides that said rotational phase difference is said predetermined value or greater.

18. The machine operating-state monitoring method as set forth in claim 16, further comprising:

displaying said rotational phase difference calculated by said rotational phase difference calculating step on a display section in a time-series manner.

19. A machine operating-state monitoring method of monitoring an operating state of a machine provided within a factory, by a factory-side system and a remote-side system connected through a transfer medium, said monitoring method comprising:

detecting a rotational phase difference by a rotational phase difference detecting system provided in said factory-side system, the rotational phase difference detecting system including a first rotating body with a first mark, a second rotating body with a second mark, a mark sensor configured to detect said first mark, a first camera configured to image said second mark when said mark sensor detects said first mark, and a display section configured to display said second mark imaged by said first camera, the rotational phase difference between said first and second rotating bodies being detected from a position of an image of said second mark displayed on said display section;

transmitting information on the detected rotational phase difference from said factory-side system to said remote-side system through said transfer medium;

deciding whether or not said rotational phase difference is a predetermined value or greater, based on the rotational phase difference information received by a rotational phase difference deciding section provided in said remote-side system;

transmitting a signal from said remote-side system to said factory-side system through said transfer medium when said phase difference deciding section decides that said rotational phase difference is said predetermined value or greater; and outputting an alarm provided in said factory-side system when said signal is received.

20. A machine operating-state monitoring method of monitoring an operating state of a machine provided within a factory by a factory-side system and a remote-side system connected through a transfer medium, said monitoring method comprising:

imaging a second mark provided on a second rotating body by a first camera provided in said factory-side system when a mark sensor provided in said factory-side system detects a first mark provided on a first rotating body;

transmitting information on the imaged second mark from said factory-side system to said remote-side system through said transfer medium;

calculating a rotational phase difference between said first and second rotating bodies, based on said second-mark information received by a rotational phase difference calculating section provided in said remote-side system;

deciding whether or not the calculated rotational phase difference is a predetermined value or greater, by a rotational phase difference deciding section provided in said remote-side system;

transmitting a signal from said remote-side system to said factory-side system through said transfer medium when said phase difference deciding section decides that said rotational phase difference is said predetermined value or greater; and outputting an alarm provided in said factory-side system when said signal is received.

21. A machine operating-state monitoring method of monitoring an operating state of a machine provided within a factory by a factory-side system and a remote-side system connected through a transfer medium, said monitoring method comprising:

imaging a second mark provided on a second rotating body by a first camera provided in said factory-side system when a mark sensor provided in said factory-side system detects a first mark provided on a first rotating body;

transmitting information on the imaged second mark from said factory-side system to said remote-side system through said transfer medium;

calculating a rotational phase difference between said first and second rotating bodies, based on said second-mark information received by a rotational phase difference calculating section provided in said remote-side system;

transmitting information on the calculated rotational phase difference from said remote-side system to said factory-side system through said transfer medium; and displaying the transmitted information on a display section provided in said factory-side system in a time-series manner.

22. The machine operating-state monitoring method as set forth in any one of claims 16 through 21, wherein:

a print with a possibility of printing trouble is extracted by monitoring an operating state of a printing machine; and said plurality of rotating bodies are printing rolls.

23. A rotational phase difference detecting system for detecting a rotational phase difference between a plurality of rotating bodies, comprising:

a first rotating body with a first mark;

a second rotating body with a second mark;

a mark sensor configured to detect said first mark;

a first camera configured to image said second mark when said mark sensor detects said first mark; and a display section configured to display a reference position corresponding to said first mark and to display said second mark imaged by said first camera, wherein a rotational phase difference between said first and second rotating bodies is detected from a position of an image of said second mark displayed on said display section with respect to the reference position.

24. A rotational phase difference detecting system for detecting a rotational phase difference between a plurality of rotating bodies, comprising:

a first rotating body with a first mark;

a second rotating body with a second mark;

a mark sensor configured to detect said first mark;

a first camera configured to image said second mark when said mark sensor detects said first mark; and a display section configured to display said second mark every time said first mark is detected, the first mark being detected once per each complete revolution of the first rotating body, wherein a rotational phase difference between said first and second rotating bodies is detected from a position of an image of said second mark displayed on said display section.

25. The rotational phase difference detecting system as set forth in claim 1, wherein the rotating bodies are printing rolls.

26. The rotational phase difference detecting method as set forth in forth in claim 7, wherein the rotating bodies are printing rolls.

* * * * *